US011098618B2

(12) United States Patent
Chikayama et al.

(10) Patent No.: US 11,098,618 B2
(45) Date of Patent: Aug. 24, 2021

(54) VALVE TIMING ADJUSTMENT DEVICE

(71) Applicant: Mitsubishi Electric Corporation, Tokyo (JP)

(72) Inventors: Takuya Chikayama, Tokyo (JP); Masayuki Yokoyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/964,816

(22) PCT Filed: Feb. 27, 2018

(86) PCT No.: PCT/JP2018/007309
§ 371 (c)(1),
(2) Date: Jul. 24, 2020

(87) PCT Pub. No.: WO2019/167134
PCT Pub. Date: Sep. 6, 2019

(65) Prior Publication Data

US 2021/0062688 A1 Mar. 4, 2021

(51) Int. Cl.
*F01L 1/34* (2006.01)
*F01L 1/344* (2006.01)

(52) U.S. Cl.
CPC ... *F01L 1/3442* (2013.01); *F01L 2001/34459* (2013.01); *F01L 2001/34463* (2013.01); *F01L 2001/34466* (2013.01)

(58) Field of Classification Search
CPC ..... F01L 1/3442; F01L 2001/34459; F01L 2001/34463; F01L 2001/34466; F01L 2001/34469; F01L 2001/34423; F01L 2250/02
See application file for complete search history.

(56) References Cited

U.S. PATENT DOCUMENTS 8,297,245 B2 * 10/2012 Urushihata ..... F01L 1/3442 123/90.17
2005/0226736 A1 10/2005 Lancefield et al.
2014/0261263 A1 9/2014 Smith

FOREIGN PATENT DOCUMENTS

| | | | |
|---|---|---|---|
| DE | 112014000742 | T5 | 10/2015 |
| JP | 2002-327607 | A | 11/2002 |
| JP | 5288043 | B2 | 9/2013 |
| JP | 5288044 | B2 | 9/2013 |
| WO | WO 2012/086084 | A1 | 6/2012 |
| WO | WO 2012/086085 | A1 | 6/2012 |

OTHER PUBLICATIONS

German Office Action, dated Apr. 30, 2021, for German Application No. 112018006600.2, with an English translation.

* cited by examiner

*Primary Examiner* — Zelalem Eshete
(74) *Attorney, Agent, or Firm* — Birch, Stewart, Kolasch & Birch, LLP.

(57) ABSTRACT

A press-fit member having a cylindrical shape is press-fit into a through hole formed in a vane. An advance-side lock pin and a retard-side lock pin are provided coaxially with each other inside the press-fit member. In the outer circumferential surface of the press-fit member, an advance-side lock pin-release oil passage for applying lock pin-release hydraulic pressure to an advance-side engagement groove and a retard-side lock pin-release oil passage for applying the lock pin-release hydraulic pressure, applied to the advance-side engagement groove, to a retard-side engagement groove are formed.

7 Claims, 8 Drawing Sheets

VALVE TIMING ADJUSTMENT DEVICE

TECHNICAL FIELD

The present invention relates to a valve timing adjustment device in which a lock pin engages in an intermediate position set between a most advanced position and a most retarded position.

BACKGROUND ART

A valve timing adjustment device for controlling opening and closing timings of an intake or exhaust valve has conventionally been devised. Such valve timing adjustment device includes a first rotary body, a second rotary body that is relatively rotatable with respect to the first rotary body at a predetermined angle, and a lock mechanism for locking the second rotary body in an intermediate position upon engine start-up.

For example in a valve timing adjustment device according to Patent Literature 1, a first rotary body includes a first engagement groove to which hydraulic pressure from an advancing hydraulic chamber is applied, the first engagement groove formed on a sprocket unit's inner surface that corresponds to one vane, and a second engagement groove to which hydraulic pressure from a retarding hydraulic chamber is applied, the second engagement groove formed on a front cover's inner surface that corresponds to the vane. Meanwhile, a second rotary body includes a first housing hole and a second housing hole formed in the vane in the axial direction thereof, a first lock pin housed in the first housing hole and can freely retract or protrude toward the first engagement groove, and a second lock pin housed in the second housing hole and can freely retract or protrude toward the second engagement groove. The first housing hole and the second housing hole communicate with each other at the rear ends thereof via a communication hole, and communicate with the outside via a low-pressure passage formed in a substantially L-shape inside the vane so as to cross the center of the communication hole, thereby ensuring good slidability of the first lock pin and the second lock pin.

CITATION LIST

Patent Literature

Patent Literature 1: JP 2002-327607 A

SUMMARY OF INVENTION

Technical Problem

The valve timing adjustment device of Patent Literature 1 has a problem in which it is necessary to form the communication hole and the low-pressure passage each having a complicated shape in the vane.

The present invention has been made to solve the above-described problem, and an object of the present invention is to eliminate formation of an oil passage having a complicated shape in a vane.

Solution to Problem

A valve timing adjustment device according to the present invention includes: a first rotary body including a hydraulic chamber; a second rotary body including a vane which separates the hydraulic chamber into an advance-side section and a retard-side section, the second rotary body being relatively rotatable with respect to the first rotary body, the second rotary body being accommodated in the first rotary body; and a lock mechanism for locking the second rotary body in an intermediate position between a most advanced position and a most retarded position, in which the lock mechanism includes: a through hole formed inside the vane in an axial direction of the second rotary body; a cylindrical member having a cylindrical shape introduced into the through hole in a state where axial sliding and rotational movement relative to the through hole are restricted; a first lock pin and a second lock pin provided coaxially with each other inside the cylindrical member; a first engagement groove and a second engagement groove which are formed in the first rotary body, and with which the first lock pin and the second lock pin are to be respectively engaged; a biasing member that biases the first lock pin toward the first engagement groove, and that biases the second lock pin toward the second engagement groove; a first lock pin-release oil passage that is formed in an outer circumferential surface of the cylindrical member or in an inner circumferential surface of the through hole, and that is to apply lock pin-release hydraulic pressure to the first engagement groove; and a second lock pin-release oil passage that is formed in the outer circumferential surface of the cylindrical member or in the inner circumferential surface of the through hole, and that is to apply, to the second engagement groove, the lock pin-release hydraulic pressure applied to the first engagement groove.

Advantageous Effects of Invention

According to the present invention, the lock pin-release oil passages are formed between the cylindrical member and the through hole, and thus it is not necessary to form an oil passage having a complicated shape inside a vane.

BRIEF DESCRIPTION OF DRAWINGS

FIG. 4 is a set of views illustrating an example configuration of a press-fit member of the first embodiment.

DESCRIPTION OF EMBODIMENTS

To describe this invention in more detail, modes for carrying out this invention will be described below with reference to the accompanying drawings.

First Embodiment

Figure 1:
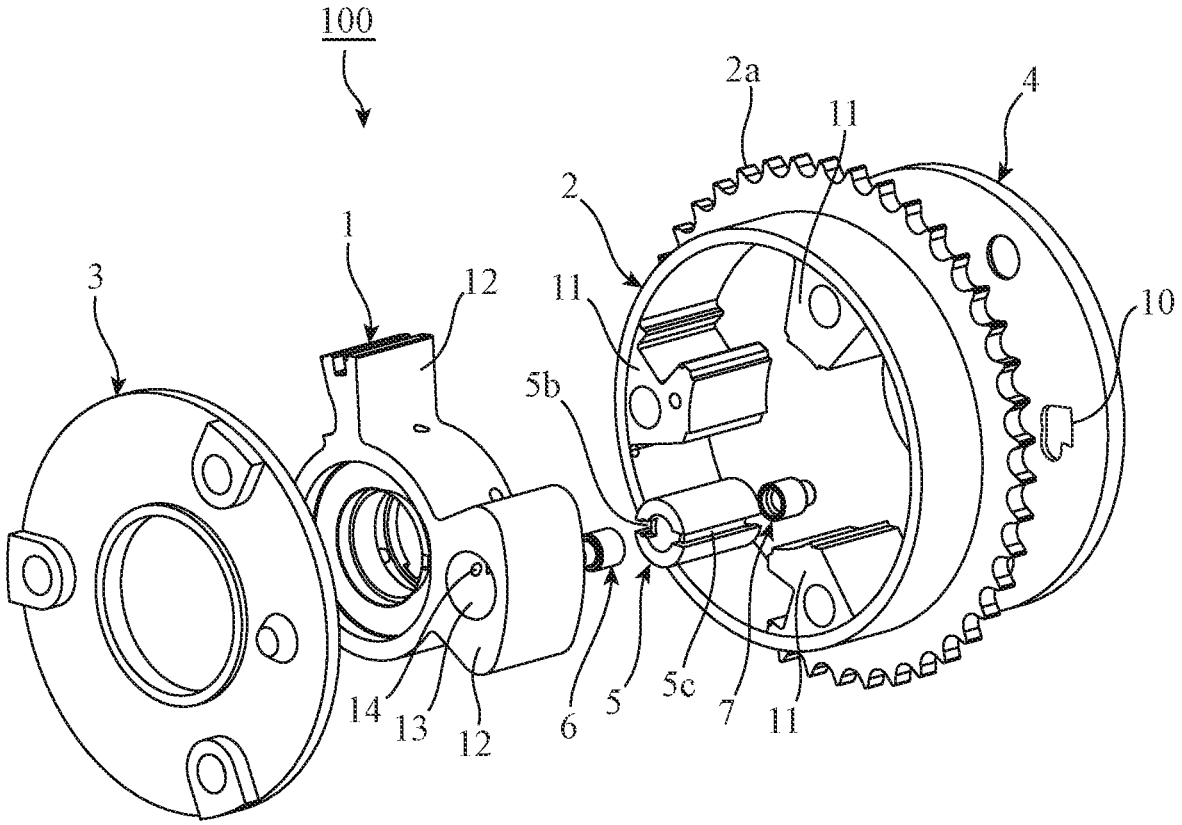
FIG. 1 is an exploded perspective view illustrating an example configuration of a valve timing adjustment device according to a first embodiment.
Figure 2:
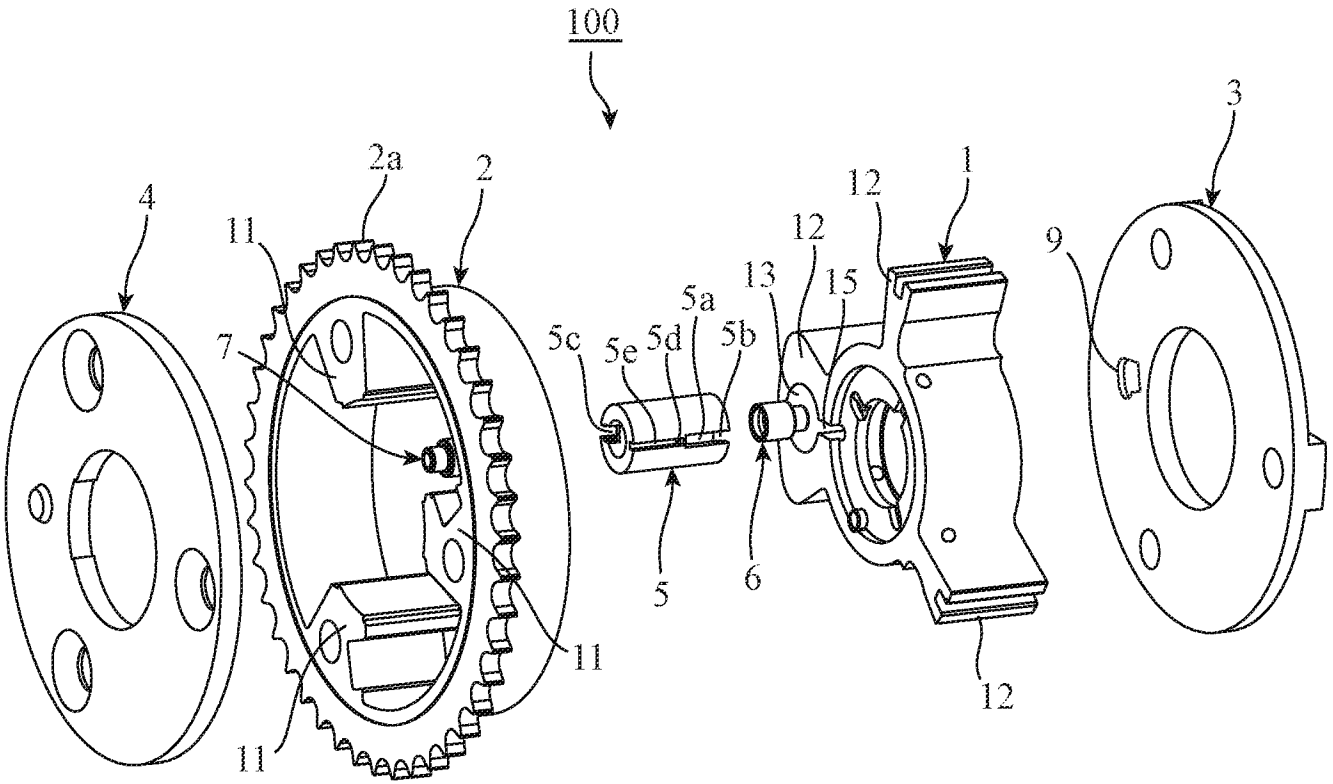
FIG. 2 is an exploded perspective view illustrating the example configuration of the valve timing adjustment device according to the first embodiment.
Figure 3:
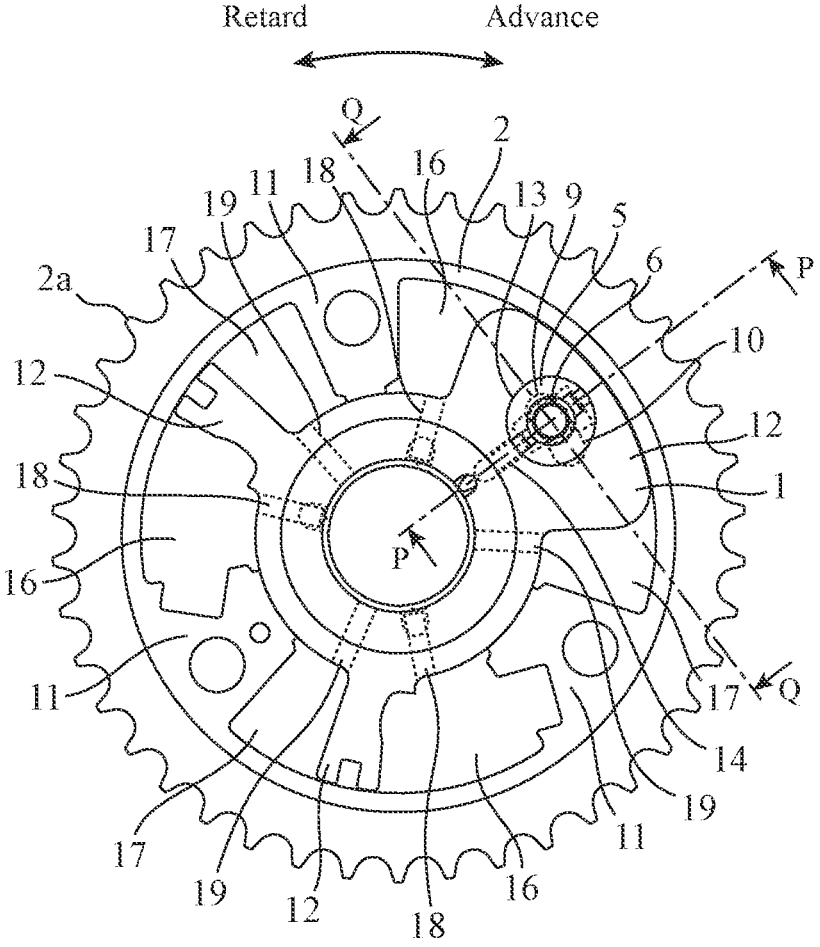
FIG. 3 is a front view illustrating the example configuration of the valve timing adjustment device according to the first embodiment.

FIG. 1 is an exploded perspective view illustrating an example configuration of a valve timing adjustment device 100 according to a first embodiment, viewed from the front. FIG. 2 is an exploded perspective view illustrating the example configuration of the valve timing adjustment device 100 according to the first embodiment, viewed from the rear. Note that FIGS. 1 and 2 do not illustrate a coil spring 8. FIG. 3 is a front view illustrating the example configuration of the valve timing adjustment device 100 according to the first embodiment, having a casing 2 being locked in an intermediate position, i.e., being in a locked state. Note that FIG. 3 does not illustrate a plate 3.

The casing 2 includes multiple shoes 11 projecting radially inwardly and forming multiple hydraulic chambers. A rotor 1 includes multiple vanes 12 that each separate the corresponding one of the hydraulic chambers of the casing 2 into an advancing hydraulic chamber 16 and a retarding hydraulic chamber 17. When the rotor 1 is accommodated in the casing 2, the plate 3, the casing 2, and a cover 4 are integrated together by means of screws or the like. The integration causes both sides of the casing 2 to be covered with the plate 3 and the cover 4, and the hydraulic chambers are thus sealed. These elements, i.e., the casing 2, the plate 3, and the cover 4 are included in a first rotary body. The rotor 1 is included in a second rotary body. The second rotary body is relatively rotatable with respect to the first rotary body.

The casing 2 has sprockets 2*a* formed on the outer circumference thereof. A timing belt (not shown) placed on these sprockets 2*a* transmits driving force of the crankshaft of the engine to the casing 2, thereby causing the first rotary body including the casing 2, the plate 3, and the cover 4 to rotate in synchronism with the crankshaft. Meanwhile, the rotor 1 is fixed to a camshaft 20 illustrated in FIG. 5 mentioned later, and rotates in synchronism with the camshaft.

The rotor 1 includes multiple advancing oil passages 18, multiple retarding oil passages 19, and one rotor-side lock pin-release oil passage 14 each formed therein. The advancing oil passages 18 communicate with the respective advancing hydraulic chambers 16, while the retarding oil passages 19 communicate with the respective retarding hydraulic chambers 17. The rotor-side lock pin-release oil passage 14 communicates with an advance-side lock pin-release oil passage 5*a* described later.

Hydraulic pressure applied and removed through an oil control valve (not illustrated) is applied to, and removed from, the advancing hydraulic chambers 16 and the retarding hydraulic chambers 17 respectively through the advancing oil passages 18 and through the retarding oil passages 19. Application of hydraulic pressure to the advancing hydraulic chambers 16 causes the relative phase of the second rotary body with respect to the first rotary body to be adjusted in the advance direction, which causes the relative phase of the camshaft with respect to the crankshaft to be changed in the advance direction, and thereby opening and closing timings of the intake valve or the exhaust valve of the engine also to be changed. On the other hand, application of hydraulic pressure to the retarding hydraulic chambers 17 causes the relative phase of the second rotary body with respect to the first rotary body to be adjusted in the retard direction, which causes the relative phase of the camshaft with respect to the crankshaft to be changed in the retard direction, and thereby opening and closing timings of the intake valve or the exhaust valve of the engine also to be changed. FIG. 3 illustrates the direction in which the rotor 1 rotates clockwise with respect to the casing 2 as the advance direction, and the direction in which the rotor 1 rotates counterclockwise with respect to the casing 2 as the retard direction.

In addition, one of the vanes 12 of the rotor 1 includes a lock mechanism for locking the rotor 1 in an intermediate position between the most advanced position and the most retarded position. Note that the intermediate position needs only to be a position between the most advanced position and the most retarded position, and does not need to be a midpoint in a strict sense. The lock mechanism will be described below in detail with reference to FIGS. 4 to 7.

Figure 4A:
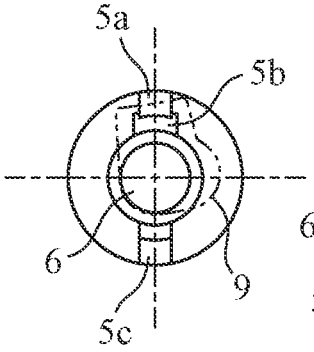
FIG. 4A illustrates the end face on the plate side.
Figure 4B:
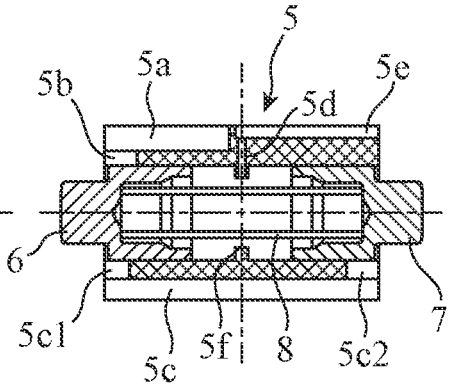
FIG. 4B illustrates a cross section.
Figure 4C:
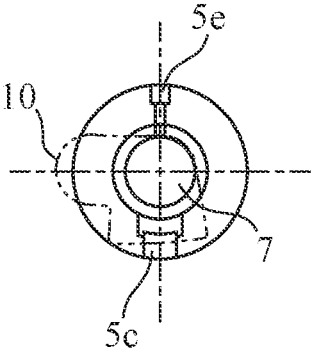
FIG. 4C illustrates the end face on the cover side.
Figure 5:
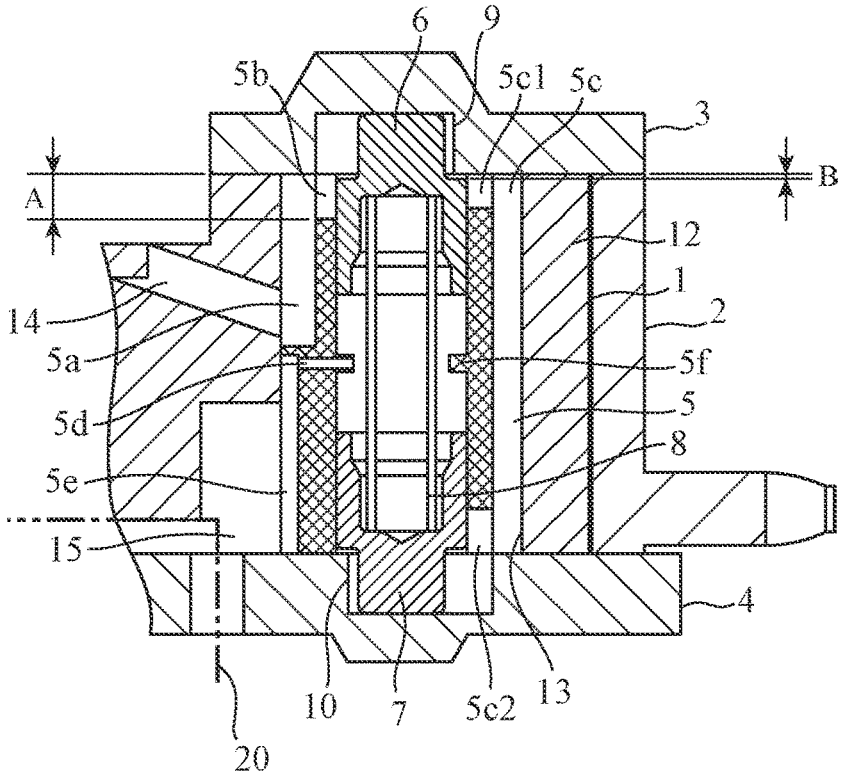
FIG. 5 is a cross-sectional view of the lock mechanism of the first embodiment taken along line P-P of FIG. 3, illustrating a locked state.
Figure 6:
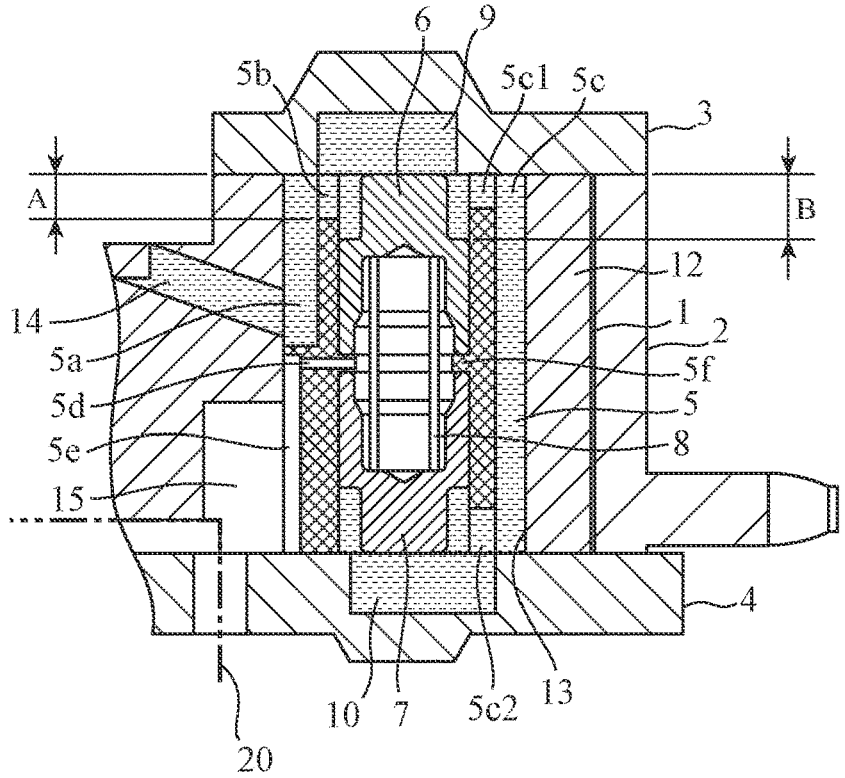
FIG. 6 is a cross-sectional view of the lock mechanism of the first embodiment taken along line P-P of FIG. 3, illustrating an unlocked state.
Figure 7:
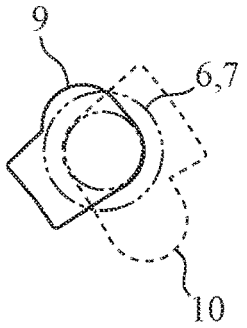
FIG. 7 is a front view illustrating an example of formation of an advance-side engagement groove and of a retard-side engagement groove of the first embodiment.

FIG. 4 is a set of views illustrating an example configuration of a press-fit member 5; FIG. 4A illustrates the end face on the plate 3 side, FIG. 4B illustrates a cross section, and FIG. 4C illustrates the end face on the cover 4 side. FIG. 5 is a cross-sectional view of the lock mechanism of the first embodiment taken along line P-P of FIG. 3, illustrating a locked state. FIG. 6 is a cross-sectional view of the lock mechanism of the first embodiment taken along line P-P of FIG. 3, illustrating an unlocked state. FIG. 7 is a front view illustrating an example of formation of an advance-side engagement groove 9 and of a retard-side engagement groove 10 of the first embodiment. FIG. 7 illustrates the shape of the advance-side engagement groove 9 using a solid line, the shape of the retard-side engagement groove 10 using a broken line, and the shapes of an advance-side lock pin 6 and of a retard-side lock pin 7 using a dashed-double-dotted line.

One of the vanes 12 has a through hole 13 formed therein to penetrate the vane 12 in the axial direction of the casing 2. The press-fit member 5, having a cylindrical shape, is press-fit into the through hole 13. Being press fit into the through hole 13, the press-fit member 5 is introduced into the through hole 13 in a state in which axial sliding and rotational movement relative to the through hole 13 are restricted. Note that, as described later, the press-fit member 5 needs only to communicate with the rotor-side lock pin-release oil passage 14 of the rotor 1 to form a lock pin-release oil passage, and accordingly, there is no need to be introduced into the through hole 13 by press fitting. For example, a configuration in which a cylindrical member is inserted in the through hole 13 will allow this cylindrical member to function equivalently to the press-fit member 5 if this cylindrical member will not undergo axial sliding or rotational movement.

The advance-side lock pin 6 and the retard-side lock pin 7 are provided coaxially with each other inside the press-fit member 5. In the plate 3, an arc-shaped groove is formed which has the radius of curvature corresponding to the rotational direction of the casing 2, at a position facing the advance-side lock pin 6, and another groove is formed which projects from this arc-shaped groove in a direction to face a cutout portion 5*b* of the press-fit member 5 described later. These grooves together form the advance-side engagement groove 9. Moreover, in the cover 4, an arc-shaped groove is formed which has the radius of curvature corresponding to the rotational direction of the casing 2, at a position facing the retard-side lock pin 7, and another groove is formed which projects from this arc-shaped groove in a direction to face a cutout portion 5*c*2 of the press-fit member 5 described later. These grooves together form the retard-side engagement groove 10.

One coil spring 8, which is a biasing member, is provided between the advance-side lock pin 6 and the retard-side lock pin 7. This coil spring 8 biases the advance-side lock pin 6 toward the advance-side engagement groove 9 to engage the advance-side lock pin 6 with the advance-side engagement groove 9, and at the same time, biases the retard-side lock pin 7 toward the retard-side engagement groove 10 to engage the retard-side lock pin 7 with the retard-side engagement groove 10.

The outer circumferential surface of the press-fit member 5 has a groove formed therein that extends from the rotor-side lock pin-release oil passage 14 to the advance-side engagement groove 9, and this groove is the advance-side lock pin-release oil passage 5*a*. This groove is covered and sealed by the inner circumferential surface of the through hole 13 and by the inner surface of the plate 3. In addition, the press-fit member 5 has a portion facing the advance-side engagement groove 9 in the advance-side lock pin-release oil passage 5*a* being cut out to form the cutout portion 5*b*. Formation of the cutout portion 5*b* permits the advance-side lock pin-release oil passage 5*a* and the advance-side engagement groove 9 to communicate with each other. Lock pin-release hydraulic pressure applied to the rotor-side lock pin-release oil passage 14 is applied from the rotor-side lock pin-release oil passage 14 through the advance-side lock pin-release oil passage 5*a* and through the cutout portion 5*b* to the advance-side engagement groove 9. The lock pin-release hydraulic pressure applied to the advance-side engagement groove 9 causes the advance-side lock pin 6 to withdraw from the advance-side engagement groove 9 against biasing force of the coil spring 8, thereby releasing the engagement between the advance-side lock pin 6 and the advance-side engagement groove 9. During the engagement, oil accumulated in the advance-side engagement groove 9 is drained through the advance-side lock pin-release oil passage 5*a* to the rotor-side lock pin-release oil passage 14.

The outer circumferential surface of the press-fit member 5 also has a groove formed therein that extends from the advance-side engagement groove 9 to the retard-side engagement groove 10, and cutout portions 5*c*1 and 5*c*2 formed therein by cutting out at both end portions of the groove. The groove and the cutout portions 5*c*1 and 5*c*2 together form a retard-side lock pin-release oil passage 5*c*. The groove and the cutout portions 5*c*1 and 5*c*2 are covered and sealed by the inner circumferential surface of the through hole 13, by the inner surface of the plate 3, and by the inner surface of the cover 4. However, when the advance-side lock pin 6 is withdrawn from the advance-side engagement groove 9 causing the engagement to be released, a clearance is formed between the advance-side lock pin 6 and the advance-side engagement groove 9, and this clearance communicates with the cutout portion 5*c*1 on the advance-side engagement groove 9 side, of the retard-side lock pin-release oil passage 5*c*. In addition, the cutout portion 5*c*2 is formed at a position facing the retard-side engagement groove 10. Lock pin-release hydraulic pressure applied to the advance-side engagement groove 9 is applied from the foregoing clearance formed between the advance-side lock pin 6 and the advance-side engagement groove 9 through the retard-side lock pin-release oil passage 5*c* to the retard-side engagement groove 10. The lock pin-release hydraulic pressure applied to the retard-side engagement groove 10 causes the retard-side lock pin 7 to withdraw from the retard-side engagement groove 10 against biasing force of the coil spring 8, thereby releasing the engagement between the retard-side lock pin 7 and the retard-side engagement groove 10. During the engagement, oil accumulated in the retard-side engagement groove 10 is drained through the retard-side lock pin-release oil passage 5*c*, through the advance-side engagement groove 9, and through the advance-side lock pin-release oil passage 5*a* to the rotor-side lock pin-release oil passage 14.

Note that the groove of the advance-side lock pin-release oil passage 5*a* and the groove of the retard-side lock pin-release oil passage 5*c* may each have a linear shape or any shape such as a helical shape.

In addition, although the illustrated example is illustrated so that the advance-side lock pin-release oil passage 5*a* and the retard-side lock pin-release oil passage 5*c* are provided at equal intervals, both the oil passages may have any positional relationship.

As illustrated in FIG. 5, when biasing force of the coil spring 8 acts on the advance-side lock pin 6 to engage with the advance-side engagement groove 9, and acts on the retard-side lock pin 7 to engage with the retard-side engagement groove 10, the rotor 1 is locked in an intermediate position. In contrast, as illustrated in FIG. 6, when lock pin-release hydraulic pressure applied from the rotor-side lock pin-release oil passage 14 acts on the advance-side lock pin 6 to disengage from the advance-side engagement groove 9, and acts on the retard-side lock pin 7 to disengage from the retard-side engagement groove 10, the rotor 1 becomes relatively rotatable. Note that abutment, on a stopper 5*f* of the press-fit member 5, of the advance-side lock pin 6 and of the retard-side lock pin 7 withdrawn respectively from the advance-side engagement groove 9 and from the retard-side engagement groove 10 prevents the advance-side lock pin 6 and the retard-side lock pin 7 from being withdrawn further.

The advance-side lock pin 6 does not receive cam torque in the retard direction, and thus easily comes out of the advance-side engagement groove 9. In contrast, the retard-side lock pin 7 receives cam torque and is thus pressed on a retard-side side wall of the retard-side engagement groove 10, and is accordingly not easy to come out of the retard-side engagement groove 10. Thus, the lock mechanism of the first embodiment is structured to first release the engagement of the advance-side lock pin 6 not receiving cam torque, and then release the engagement of the retard-side lock pin 7. This structure enables the advance-side lock pin 6 to be reliably disengaged before the retard-side lock pin 7.

In addition, to reliably disengage the advance-side lock pin 6 before the retard-side lock pin 7, the structure described below is desirable.

Let "A" denote the length of the cutout portion 5*b* in the axial direction of the casing 2. In addition, let "B" denote the length of the clearance between the advance-side lock pin 6 and the advance-side engagement groove 9 in the axial direction of the casing 2. The clearance having the length "B" is a clearance to be formed when the advance-side lock pin 6 is disengaged from the advance-side engagement groove 9, and serves as an oil passage for applying the lock pin-release hydraulic pressure from the advance-side engagement groove 9 to the retard-side lock pin-release oil passage 5*c*. The magnitude relationship between A and B is A>B in the locked state illustrated in FIG. 5, and A≤B in the unlocked state illustrated in FIG. 6. This magnitude relationship ensures that the retard-side lock pin-release oil passage 5*c* will not be established unless the advance-side lock pin 6 is disengaged in the locked state of FIG. 5, thereby enabling the advance-side lock pin 6 to be reliably disengaged.

A fluid drain channel 5*d*, which is a through hole communicating between the inside and the outside of the press-fit member 5, is formed at the position of the stopper 5*f* of the press-fit member 5. In addition, a fluid drain channel 5*e*, which is a groove communicating between the fluid drain channel 5*d* and a rotor-side fluid drain channel 15, is formed in the outer circumferential surface of the press-fit member 5. Clearances are inevitably formed between the press-fit member 5 and the advance-side lock pin 6 and between the press-fit member 5 and the retard-side lock pin 7 to permit the advance-side lock pin 6 and the retard-side lock pin 7 to slide. Oil and air flow into the press-fit member 5 through these clearances. The oil and air are drained through the fluid drain channel 5*d* and through the fluid drain channel 5*e*, out of the rotor-side fluid drain channel 15.

As described above, the through hole 13 included in the lock mechanism of the first embodiment is formed inside one of the vanes 12 in the axial direction of the rotor 1, which is included in the second rotary body. The press-fit member 5 is a cylindrical member, and is introduced into the through hole 13 in a state in which axial sliding and rotational movement relative to the through hole 13 are restricted. The advance-side lock pin 6 and the retard-side lock pin 7 are provided coaxially with each other inside the press-fit member 5. The advance-side engagement groove 9 and the retard-side engagement groove 10 are respectively formed in the plate 3 and in the cover 4 included in the first rotary body to respectively allow the advance-side lock pin 6 and the retard-side lock pin 7 to engage therewith. The coil spring 8 biases the advance-side lock pin 6 toward the advance-side engagement groove 9, and biases the retard-side lock pin 7 toward the retard-side engagement groove 10. The advance-side lock pin-release oil passage 5*a* is formed in the outer circumferential surface of the press-fit member 5 to apply the lock pin-release hydraulic pressure to the advance-side engagement groove 9. The retard-side lock pin-release oil passage 5*c* is formed in the outer circumferential surface of the press-fit member 5 to apply the lock pin-release hydraulic pressure applied to the advance-side engagement groove 9, to the retard-side engagement groove 10. As such, the simply-shaped longitudinal grooves formed in the outer circumferential surface of the press-fit member 5 serve as the advance-side lock pin-release oil passage 5*a* and the retard-side lock pin-release oil passage 5*c*. This eliminates the need for forming a lock pin-release oil passage having a complicated shape inside the vane 12, and it is thus sufficient to form the through hole 13 having a simple shape in the vane 12.

In addition, the press-fit member 5 of the first embodiment has the cutout portion 5*b* in a portion of the advance-side lock pin-release oil passage 5*a*, the portion being to face the advance-side engagement groove 9. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A of the cutout portion 5*b* in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A of the cutout portion 5*b* in the axial direction of the casing 2. This enables the advance-side lock pin 6 to be reliably disengaged before the retard-side lock pin 7.

Moreover, the press-fit member 5 of the first embodiment has the fluid drain channels 5*d* and 5*e* for draining fluid between the advance-side lock pin 6 and the retard-side lock pin 7 to the outside. Meanwhile, this only requires, in the corresponding one of the vanes 12, formation of a longitudinal hole communicating with the fluid drain channels 5*d* and 5*e*, i.e., the rotor-side fluid drain channel 15. A method is often used conventionally in which a transverse hole is formed in the rotor 1 to be used as the rotor-side fluid drain channel, but in the first embodiment, a longitudinal hole is formed in the rotor 1, and the longitudinal hole can be used as the rotor-side fluid drain channel 15. This enables a fluid drain channel to be implemented by an easier production operation than conventional ones.

Note that the fluid drain channel 5*e* may be not provided, and the fluid drain channel 5*d* may be structured to communicate directly with the rotor-side fluid drain channel 15.

Furthermore, the coil spring 8 of the first embodiment may have a linear spring constant or may have a non-linear spring constant. A coil spring 8 having a non-linear spring constant is an irregular pitch spring whose biasing force varies during expansion and contraction, or other similar spring. For example, a coil spring 8 having a non-linear spring constant is used in such a manner that force to bias the retard-side lock pin 7 toward the retard-side engagement groove 10 is greater than force to bias the advance-side lock pin 6 toward the advance-side engagement groove 9. This can prevent a situation in which, during an unlocking operation, the retard-side lock pin 7 is disengaged from the retard-side engagement groove 10 before the advance-side lock pin 6 is disengaged from the advance-side engagement groove 9 even if the lock pin-release hydraulic pressure leaks through the clearance to the retard-side engagement groove 10.

Second Embodiment

Figure 8:
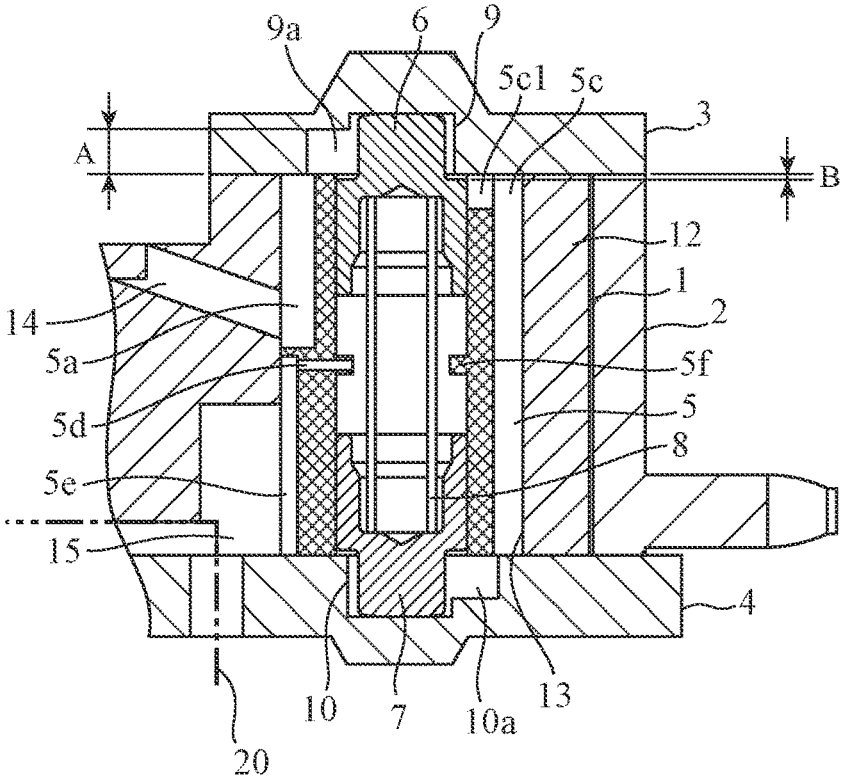
FIG. 8 is a cross-sectional view of a lock mechanism of a second embodiment taken along line P-P of FIG. 3, illustrating a locked state.
Figure 9:
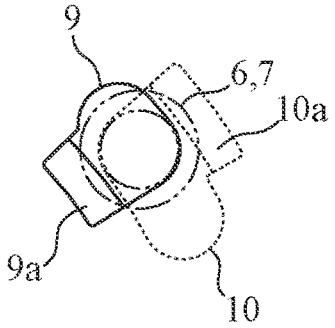
FIG. 9 is a front view illustrating an example of formation of an advance-side engagement groove and of a retard-side engagement groove of the second embodiment.

A valve timing adjustment device 100 according to a second embodiment is structured the same as the valve timing adjustment device 100 according to the first embodiment except for the lock mechanism, and FIGS. 1 to 7 thus also apply to the following description. FIG. 8 is a cross-sectional view of a lock mechanism of the second embodiment taken along line P-P of FIG. 3, illustrating a locked state. FIG. 9 is a front view illustrating an example of formation of an advance-side engagement groove 9 and of a retard-side engagement groove 10 of the second embodiment. FIG. 9 illustrates the shape of the advance-side engagement groove 9 using a solid line, the shape of the retard-side engagement groove 10 using a broken line, and the shapes of the advance-side lock pin 6 and of the retard-side lock pin 7 using a dashed-double-dotted dotted line. In FIGS. 8 and 9, elements identical or equivalent to the corresponding elements of FIGS. 1 to 7 are indicated by the same reference characters, and a description thereof will be omitted.

In the first embodiment, the press-fit member 5 is structured to have the cutout portion 5*b*, but in the second embodiment, a recessed portion 9*a* is formed in place of this cutout portion 5*b*. Specifically, the advance-side engagement groove 9 has a recessed portion 9*a*, which is a recess formed in a portion facing the advance-side lock pin-release oil passage 5*a*. Formation of the recessed portion 9*a* permits the advance-side lock pin-release oil passage 5*a* and the advance-side engagement groove 9 to communicate with each other. The lock pin-release hydraulic pressure applied to the rotor-side lock pin-release oil passage 14 is applied from the rotor-side lock pin-release oil passage 14 through the advance-side lock pin-release oil passage 5*a* and through the recessed portion 9*a* to the advance-side engagement groove 9.

Note that similarly to the configuration on the advance side, a recessed portion 10*a* may be formed in the retard-side engagement groove 10 in place of the cutout portion 5*c*2 on the retard side. The lock pin-release hydraulic pressure applied to the advance-side engagement groove 9 is applied from the advance-side engagement groove 9 through the cutout portion 5*c*1, through the retard-side lock pin-release oil passage 5*c*, and through the recessed portion 10*a* to the retard-side engagement groove 10.

Let "A" denote the length of the recessed portion 9*a* in the axial direction of the casing 2. In addition, similarly to the first embodiment, let "B" denote the length of the clearance between the advance-side lock pin 6 and the advance-side engagement groove 9 in the axial direction of the casing 2. The magnitude relationship between A and B is A>B in the locked state illustrated in FIG. 8, and A≤B in the unlocked state (not shown). This magnitude relationship ensures that the retard-side lock pin-release oil passage 5*c* will not be established unless the advance-side lock pin 6 is disengaged in the locked state of FIG. 8, thereby enabling the advance-side lock pin 6 to be reliably disengaged.

As described above, the advance-side engagement groove 9 of the second embodiment has the recessed portion 9*a*, which is a recess formed in a portion which is to face the advance-side lock pin-release oil passage 5*a*. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A of the recessed portion 9*a* in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A of the recessed portion 9*a* in the axial direction of the casing 2. This enables the advance-side lock pin 6 to be reliably disengaged before the retard-side lock pin 7.

Third Embodiment

Figure 10:
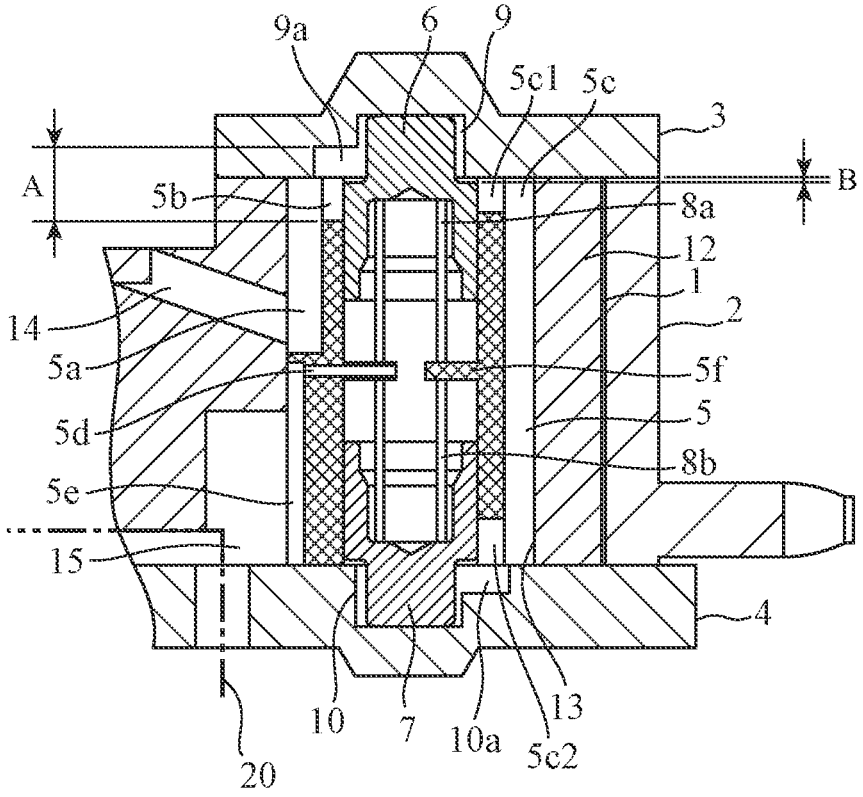
FIG. 10 is a cross-sectional view of a lock mechanism of a third embodiment taken along line P-P of FIG. 3, illustrating a locked state.

A valve timing adjustment device 100 according to a third embodiment is structured the same as the valve timing adjustment device 100 according to the first embodiment except for the lock mechanism, and FIGS. 1 to 7 thus also apply to the following description. FIG. 10 is a cross-sectional view of a lock mechanism of the third embodiment taken along line P-P of FIG. 3, illustrating a locked state. In FIG. 10, elements identical or equivalent to the corresponding elements of FIGS. 1 to 9 are indicated by the same reference characters, and a description thereof will be omitted.

In the first embodiment, the press-fit member 5 is structured to have the cutout portion 5*b*, but in the third embodiment, the recessed portion 9*a* described in the second embodiment is also formed in addition to this cutout portion 5*b*. Specifically, the advance-side engagement groove 9 has the recessed portion 9*a*, which is a recess formed in a portion facing the cutout portion 5*b* of the press-fit member 5. Formation of the cutout portion 5*b* and the recessed portion 9*a* permits the advance-side lock pin-release oil passage 5*a* and the advance-side engagement groove 9 to communicate with each other. The lock pin-release hydraulic pressure applied to the rotor-side lock pin-release oil passage 14 is applied from the rotor-side lock pin-release oil passage 14 through the advance-side lock pin-release oil passage 5*a*, through the cutout portion 5*b*, and through the recessed portion 9*a* to the advance-side engagement groove 9.

Note that similarly to the configuration on the advance side, the recessed portion 10*a* may be formed in the retard-side engagement groove 10 also on the retard side in addition to the cutout portion 5*c*2. The lock pin-release hydraulic pressure applied to the advance-side engagement groove 9 is applied from the advance-side engagement groove 9 through the cutout portion 5*c*1, through the retard-side lock pin-release oil passage 5*c*, through the cutout portion 5*c*2, and through the recessed portion 10*a* to the retard-side engagement groove 10.

Let "A" denote the length that is the sum of the length of the cutout portion 5*b* and the length of the recessed portion 9*a* in the axial direction of the casing 2. In addition, similarly to the first embodiment, let "B" denote the length of the clearance between the advance-side lock pin 6 and the advance-side engagement groove 9 in the axial direction of the casing 2. The magnitude relationship between A and B is A>B in the locked state illustrated in FIG. 10, and A≤B in the unlocked state (not shown). This magnitude relationship ensures that the retard-side lock pin-release oil passage 5*c* will not be established unless the advance-side lock pin 6 is disengaged in the locked state of FIG. 10, thereby enabling the advance-side lock pin 6 to be reliably disengaged.

As described above, the press-fit member 5 of the third embodiment has the cutout portion 5*b* in a portion of the advance-side lock pin-release oil passage 5*a*, the portion being to face the advance-side engagement groove 9. In addition, the advance-side engagement groove 9 has the recessed portion 9*a*, which is a recess formed in a portion which is to face the cutout portion 5*b*. In this configuration, when the advance-side lock pin 6 is engaged with the advance-side engagement groove 9, the length B of the clearance between the advance-side lock pin 6 and the advance-side engagement groove 9, the clearance communicating with the retard-side lock pin-release oil passage 5*c*, is less than the length A, which is the sum of the length of the cutout portion 5*b* and the length of the recessed portion 9*a*, in the axial direction of the casing 2. Meanwhile, when the advance-side lock pin 6 is disengaged from the advance-side engagement groove 9, the length B of the clearance between the advance-side lock pin 6 and the advance-side engagement groove 9, the clearance communicating with the retard-side lock pin-release oil passage 5*c*, is greater than or equal to the length A, which is the sum of the length of the cutout portion 5*b* and the length of the recessed portion 9*a*, in the axial direction of the casing 2. This enables the advance-side lock pin 6 to be reliably disengaged before the retard-side lock pin 7.

In addition, one coil spring 8 is used in the first embodiment, but in the third embodiment, two coil springs 8*a* and 8*b* are used. The coil spring 8*a*, corresponding to a first coil spring, biases the advance-side lock pin 6 toward the advance-side engagement groove 9. The coil spring 8*b*, corresponding to a second coil spring, biases the retard-side lock pin 7 toward the retard-side engagement groove 10. Note that the biasing force of the coil spring 8*b* may be greater than the biasing force of the coil spring 8*a*. This can prevent a situation in which, during an unlocking operation, the retard-side lock pin 7 is disengaged from the retard-side engagement groove 10 before the advance-side lock pin 6 is disengaged from the advance-side engagement groove 9 even if the lock pin-release hydraulic pressure leaks through the clearance to the retard-side engagement groove 10.

Fourth Embodiment

Figure 11:
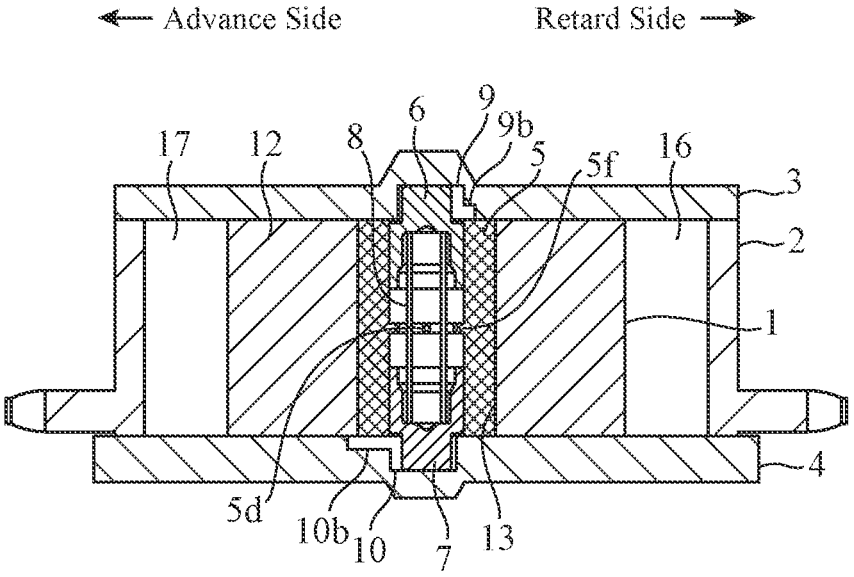
FIG. 11 is a cross-sectional view of a lock mechanism of a fourth embodiment taken along line Q-Q of FIG. 3, illustrating a locked state.
Figure 12:
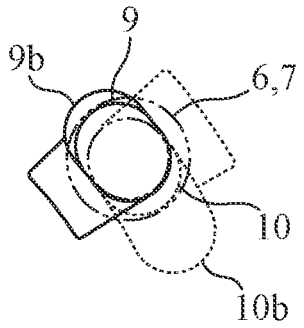
FIG. 12 is a front view illustrating an example of formation of an advance-side engagement groove and of a retard-side engagement groove of the fourth embodiment.

A valve timing adjustment device 100 according to a fourth embodiment is structured the same as the valve timing adjustment device 100 according to the first embodiment except for the lock mechanism, and FIGS. 1 to 7 thus also apply to the following description. FIG. 11 is a cross-sectional view of a lock mechanism of the fourth embodiment taken along line Q-Q of FIG. 3, illustrating a locked state. FIG. 12 is a front view illustrating an example of formation of an advance-side engagement groove 9 and of a retard-side engagement groove 10 of the fourth embodiment.

In the first embodiment, the depth of each of the advance-side engagement groove 9 and the retard-side engagement groove 10 is constant in the relative rotational direction, but in the fourth embodiment, the advance-side engagement groove 9 includes a stepped portion 9*b* having at least one step formed on the retard side to cause the advance-side engagement groove 9 to have a stepped depth. In addition, the retard-side engagement groove 10 has a stepped portion 10*b* having at least one step formed on the advance side to cause the retard-side engagement groove 10 to have a stepped depth. Note that the depth may be stepped only on the advance side or on the retard side, or the depth may be stepped on both the advance and retard sides. When either the advance-side lock pin 6 or the retard-side lock pin 7 is in an engaged state, this causes the advance-side lock pin 6 or the retard-side lock pin 7 to abut a wall formed by the advance-side engagement groove 9 and the stepped portion 9*b*, or a wall formed by the retard-side engagement groove 10 and the stepped portion 10*b* even if the valve timing adjustment device 100 is subject to vibration, and thereby prevents relative rotation of the rotor 1.

Note that the valve timing adjustment devices 100 according to the second embodiment and the third embodiment may also be structured so that the stepped portion 9*b* and the stepped portion 10*b* are respectively formed in the advance-side engagement groove 9 and in the retard-side engagement groove 10.

Fifth Embodiment

Figure 13:
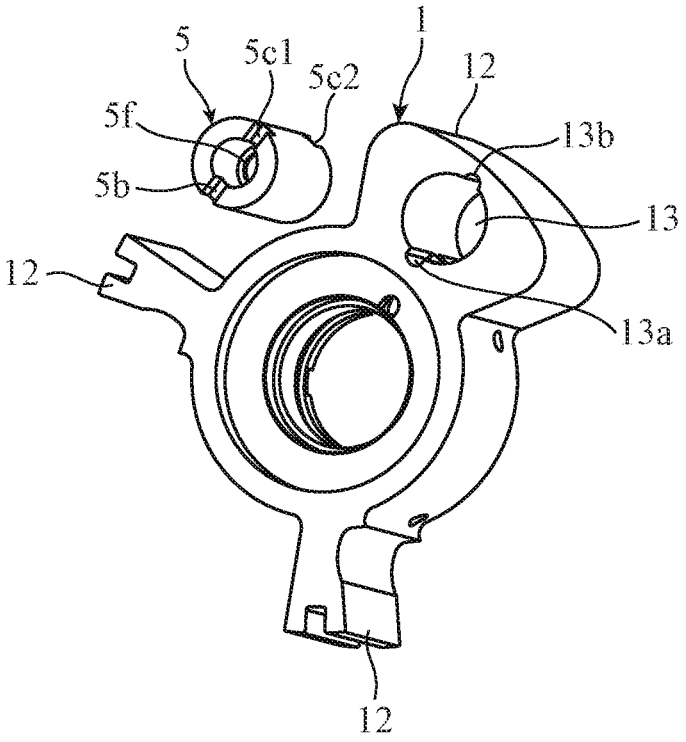
FIG. 13 is an exploded perspective view illustrating an example configuration of a rotor and of a press-fit member of a valve timing adjustment device according to a fifth embodiment.
Figure 14:
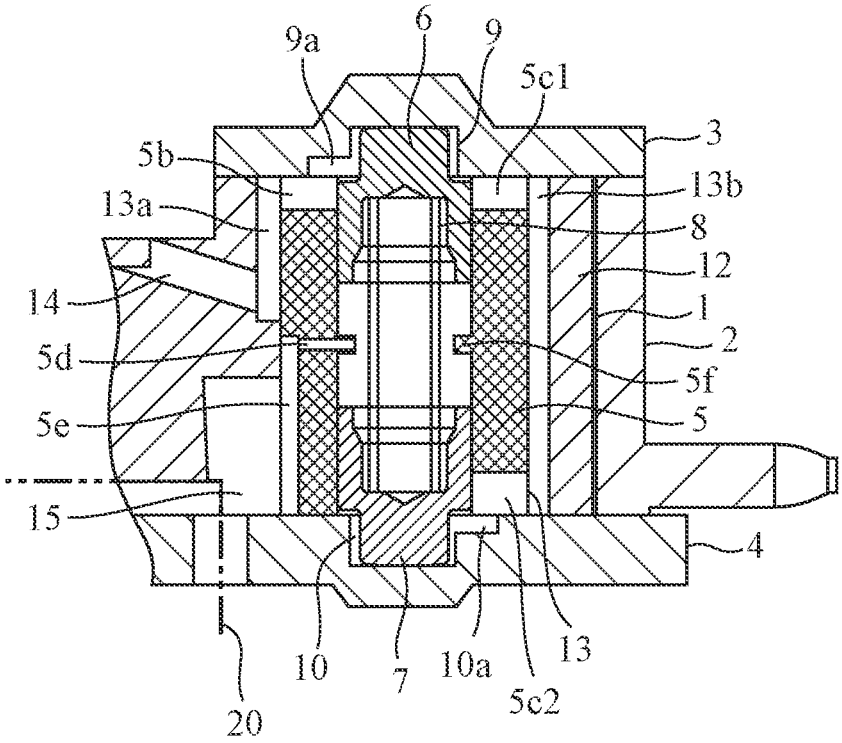
FIG. 14 is a cross-sectional view of a lock mechanism of the fifth embodiment taken along line P-P of FIG. 3, illustrating a locked state.

A valve timing adjustment device 100 according to a fifth embodiment is structured the same as the valve timing adjustment devices 100 according to the first to fourth embodiments except for the lock mechanism, and FIGS. 1 to 12 thus also apply to the following description. FIG. 13 is an exploded perspective view illustrating an example configuration of a rotor 1 and of a press-fit member 5 of the valve timing adjustment device 100 according to the fifth embodiment. FIG. 14 is a cross-sectional view of a lock mechanism of the fifth embodiment taken along line P-P of FIG. 3, illustrating a locked state.

In the first to fourth embodiments, the press-fit member 5 is structured to have the advance-side lock pin-release oil passage 5*a*, but in the fifth embodiment, the through hole 13 is structured to have an advance-side lock pin-release oil passage 13*a*. As illustrated in FIGS. 13 and 14, the inner circumferential surface of the through hole 13 has a groove formed therein that extends from the rotor-side lock pin-release oil passage 14 to the cutout portion 5*b* of the press-fit member 5, and this groove is the advance-side lock pin-release oil passage 13*a*.

Similarly, the press-fit member 5 is structured to have the retard-side lock pin-release oil passage 5*c*, but the through hole 13 may be structured to have a retard-side lock pin-release oil passage 13*b*. As illustrated in FIGS. 13 and 14, the inner circumferential surface of the through hole 13 has a groove formed therein that extends from the advance-side engagement groove 9 to the retard-side engagement groove 10, and this groove is the retard-side lock pin-release oil passage 13*b*.

In the fifth embodiment, the simply-shaped longitudinal grooves formed in the inner circumferential surface of the through hole 13 serve as the advance-side lock pin-release oil passage 13*a* and the retard-side lock pin-release oil passage 13*b*. This eliminates the need for forming a lock pin-release oil passage having a complicated shape inside the vane 12.

The foregoing description describes the advance side as the "first" side, which is the upstream side where the lock pin-release hydraulic pressure is applied first, and the retard side as the "second" side, which is the downstream side. Accordingly, the term "first lock pin" corresponds to the advance-side lock pin 6, and the term "second lock pin" corresponds to the retard-side lock pin 7. In addition, the term "first engagement groove" corresponds to the advance-side engagement groove 9, and the term "second engagement groove" corresponds to the retard-side engagement groove 10. Moreover, the term "first lock pin-release oil passage" corresponds to the advance-side lock pin-release oil passage 5*a* or 13*a*, and the term "second lock pin-release oil passage" corresponds to the retard-side lock pin-release oil passage 5*c* or 13*b*.

However, depending on the attachment direction of the valve timing adjustment device 100 to the engine, the advance direction and the retard direction may be opposite. Specifically, the advance-side lock pin 6 and the advance-side engagement groove 9 function as the retard-side lock pin and the retard-side engagement groove, and the retard-side lock pin 7 and the retard-side engagement groove 10 function as the advance-side lock pin and the advance-side engagement groove. In addition, the advance-side lock pin-release oil passages 5*a* and 13*a* each function as the retard-side lock pin-release oil passage, and the retard-side lock pin-release oil passages 5*c* and 13*b* each function as the advance-side lock pin-release oil passage. In this case, the retard side is represented by the term "first", and the advance side is represented by the term "second". In addition, the advance-side lock pin 6 that functions as the retard-side lock pin is to be first disengaged, and the retard-side lock pin 7 that functions as the advance-side lock pin is to then be disengaged. Note that the advance-side lock pin 6 that functions as the retard-side lock pin receives cam torque, and thus is not easy to come out. Accordingly, it is desirable to use the coil spring 8 having a non-linear spring constant or the two coil springs 8*a* and 8*b* in such a manner that the advance-side lock pin 6 that functions as the retard-side lock pin is biased with less force, and the retard-side lock pin 7 that functions as the advance-side lock pin is biased with greater force, thereby allowing the advance-side lock pin 6 that functions as the retard-side lock pin to be reliably disengaged first.

Note that the present invention covers any combination of the foregoing embodiments, modification of any component in the embodiments, or omission of any component in the embodiments that falls within the scope of the invention.

INDUSTRIAL APPLICABILITY

A valve timing adjustment device according to the present invention has a configuration in which a rotor is locked in an intermediate position by two lock pins, and thus is suitable for use as a valve timing adjustment device for adjusting the opening and closing timings of an intake valve and an exhaust valve of an engine.

REFERENCE SIGNS LIST

1: rotor (second rotary body), 2: casing (first rotary body), 2*a*: sprocket, 3: plate (first rotary body), 4: cover (first rotary body), 5: press-fit member (cylindrical member), 5*a*, 13*a*: advance-side lock pin-release oil passage (first lock pin-release oil passage), 5*b*, 5*c*1, 5*c*2: cutout portion, 5*c*, 13*b*: retard-side lock pin-release oil passage (second lock pin-release oil passage), 5*d*, 5*e*: fluid drain channel, 5*f*: stopper, 6: advance-side lock pin (first lock pin), 7: retard-side lock pin (second lock pin), 8, 8*a*, 8*b*: coil spring (biasing member), 9: advance-side engagement groove (first engagement groove), 9*a*, 10*a*: recessed portion, 9*b*, 10*b*: stepped portion, 10: retard-side engagement groove (second engagement groove), 11: shoe, 12: vane, 13: through hole, 14: rotor-side lock pin-release oil passage, 15: rotor-side fluid drain channel, 16: advancing hydraulic chamber, 17: retarding hydraulic chamber, 18: advancing oil passage, 19: retarding oil passage, 20: camshaft, 100: valve timing adjustment device.

The invention claimed is:

1. A valve timing adjustment device comprising:

a first rotary body including a hydraulic chamber;

a second rotary body including a vane which separates the hydraulic chamber into an advance-side section and a retard-side section, the second rotary body being relatively rotatable with respect to the first rotary body, the second rotary body being accommodated in the first rotary body; and a lock mechanism for locking the second rotary body in an intermediate position between a most advanced position and a most retarded position, wherein the lock mechanism includes:

a through hole formed inside the vane in an axial direction of the second rotary body;

a cylindrical member having a cylindrical shape introduced into the through hole in a state in which axial sliding and rotational movement relative to the through hole are restricted;

a first lock pin and a second lock pin provided coaxially with each other inside the cylindrical member;

a first engagement groove and a second engagement groove which are formed in the first rotary body, and with which the first lock pin and the second lock pin are to be respectively engaged;

a biasing member that biases the first lock pin toward the first engagement groove, and that biases the second lock pin toward the second engagement groove;

a first lock pin-release oil passage that is formed in an outer circumferential surface of the cylindrical member or in an inner circumferential surface of the through hole, and that is to apply lock pin-release hydraulic pressure to the first engagement groove; and a second lock pin-release oil passage that is formed in the outer circumferential surface of the cylindrical member or in the inner circumferential surface of the through hole, and that is to apply, to the second engagement groove, the lock pin-release hydraulic pressure applied to the first engagement groove.

2. The valve timing adjustment device according to claim 1, wherein the cylindrical member includes a cutout portion in a portion of the first lock pin-release oil passage, the portion of the first lock pin-release oil passage being to face the first engagement groove, in a state where the first lock pin is engaged with the first engagement groove, a length of a clearance between the first lock pin and the first engagement groove is less than a length of the cutout portion in the axial direction of the second rotary body, the clearance communicating with the second lock pin-release oil passage, and in a state where the first lock pin is disengaged from the first engagement groove, the length of the clearance between the first lock pin and the first engagement groove is greater than or equal to the length of the cutout portion in the axial direction of the second rotary body, the clearance communicating with the second lock pin-release oil passage.

3. The valve timing adjustment device according to claim 1, wherein the first engagement groove includes a recess in a portion which is to face the first lock pin-release oil passage, in a state where the first lock pin is engaged with the first engagement groove, a length of a clearance between the first lock pin and the first engagement groove is less than a length of the recess in the axial direction of the second rotary body, the clearance communicating with the second lock pin-release oil passage, and in a state where the first lock pin is disengaged from the first engagement groove, the length of the clearance between the first lock pin and the first engagement groove is greater than or equal to the length of the recess in the axial direction of the second rotary body, the clearance communicating with the second lock pin-release oil passage.

4. The valve timing adjustment device according to claim 1, wherein the cylindrical member includes a cutout portion in a portion of the first lock pin-release oil passage, the portion of the first lock pin-release oil passage being to face the first engagement groove, the first engagement groove includes a recess in a portion which is to face the cutout portion, in a state where the first lock pin is engaged with the first engagement groove, a length of a clearance between the first lock pin and the first engagement groove is less than a sum length of the cutout portion and the recess in the axial direction of the second rotary body, the clearance communicating with the second lock pin-release oil passage, and in a state where the first lock pin is disengaged from the first engagement groove, the length of the clearance between the first lock pin and the first engagement groove is greater than or equal to the sum length of the cutout portion and the recess in the axial direction of the second rotary body, the clearance communicating with the second lock pin-release oil passage.

5. The valve timing adjustment device according to claim 1, wherein the cylindrical member includes a fluid drain channel for draining fluid between the first lock pin and the second lock pin to an outside.

6. The valve timing adjustment device according to claim 1, wherein the biasing member includes one coil spring having a non-linear spring constant.

7. The valve timing adjustment device according to claim 1, wherein the biasing member includes a first coil spring that biases the first lock pin toward the first engagement groove and a second coil spring that biases the second lock pin toward the second engagement groove.

* * * * *